US008925505B2

(12) United States Patent
Moeck et al.

(10) Patent No.: US 8,925,505 B2
(45) Date of Patent: Jan. 6, 2015

(54) FINGER FOLLOWER LEVER OF A VALVE TRAIN AND METHOD FOR PRODUCING THE SAME

(75) Inventors: Stephan Moeck, Pretzfeld (DE); Michael Kress, Lonnerstadt (DE); Martin Lambert, Homburg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 84 days.

(21) Appl. No.: 13/446,214

(22) Filed: Apr. 13, 2012

(65) Prior Publication Data

US 2012/0260875 A1 Oct. 18, 2012

(30) Foreign Application Priority Data

Apr. 15, 2011 (DE) ..... 10 2011 007 450

(51) Int. Cl.
*F01L 1/34* (2006.01)
*F01L 1/18* (2006.01)

(52) U.S. Cl.
CPC ..... *F01L 1/185* (2013.01); *F01L 2103/00* (2013.01); *F01L 2105/00* (2013.01)
USPC ..... 123/90.16; 123/90.39

(58) Field of Classification Search
CPC ..... F01L 1/18
USPC ..... 123/90.12, 90.16, 90.39, 90.52, 90.48
See application file for complete search history.

(56) References Cited

U.S. PATENT DOCUMENTS

| | | | | |
|---|---|---|---|---|
| 5,720,245 | A * | 2/1998 | Calka | 123/90.41 |
| 7,089,899 | B1 * | 8/2006 | Genise et al. | 123/90.39 |
| 2005/0199204 | A1 * | 9/2005 | Waseda | 123/90.39 |
| 2007/0006837 | A1 * | 1/2007 | Seitz et al. | 123/90.39 |

FOREIGN PATENT DOCUMENTS

| | | |
|---|---|---|
| DE | 100 30 341 A1 | 1/2002 |
| DE | 10 2004 012 142 A1 | 9/2005 |
| DE | 10 2009 032 143 A1 | 1/2011 |

* cited by examiner

*Primary Examiner* — Zelalem Eshete
(74) *Attorney, Agent, or Firm* — Davidson, Davidson & Kappel, LLC

(57) ABSTRACT

A finger follower lever of a valve train, which has a lever body that is a pressed and punched component made of sheet metal and has a U-shaped cross-section with two largely parallel side walls. A roller rotatably mounted between the side walls on a pin. The pin is uniformly hardened and inserted at each end into a hole punched out of the side wall and is staked or caulked at the ends. To enable the holes to be punched out simultaneously in opposite directions of a relatively narrow lever body, at least one of the two side walls has, at least on the outside thereof, a flat recess in the region of the hole.

11 Claims, 3 Drawing Sheets

FINGER FOLLOWER LEVER OF A VALVE TRAIN AND METHOD FOR PRODUCING THE SAME

CROSS-REFERENCE TO RELATED APPLICATION

This application claims the priority of DE 10 2011 007 450.3 filed Apr. 15, 2011, which is incorporated by reference herein.

FIELD OF THE INVENTION

The invention relates to a finger follower lever of a valve train (e.g., that of a piston-type internal combustion engine), which has a lever body that is a pressed and punched component made of sheet metal with a U-shaped cross-section that has two largely parallel side walls, and a roller rotatably mounted on a pin arranged between the side walls. The pin is uniformly hardened through and inserted at each end into a hole punched out of the side wall and the pin is staked or caulked at the ends, The invention furthermore relates to a method for producing a finger follower lever of this kind.

BACKGROUND OF THE INVENTION

A finger follower lever is a transmission element in a valve train (e.g., that of a piston-type internal combustion engine) via which the lifting movement of a cam brought about by the rotation of a camshaft is transmitted to a lift valve, which is opened axially against the restoring three of a valve spring in order to change the charge. For this purpose, the finger follower lever is supported in an articulated manner at one end on a housing-side supporting element and, at the opposite end, rests against the stem end of the associated lift valve. Between its ends, the finger follower lever is in contact, on the side thereof facing away from the supporting element and the lift valve, with the associated cam of the camshaft so that the lift specified by the contour of the cam can be transmitted to the stem end of the lift valve with an increase corresponding to the effective leverage. To obtain a valve train with as little friction as possible, the finger follower lever is often designed as a so-called roller finger follower lever (i.e., is provided with a rotatably mounted roller which is in contact with the associated cam of the camshaft).

In the present case, the starting point is a finger follower lever. The lever body of the finger follower is a pressed and punched component made of sheet metal that has a U-shaped cross section with two largely parallel side walls. Arranged between the side walls is a roller rotatably mounted on a pin. The pin is inserted at each end into a hole punched out of the side wall and is staked or caulked at the ends. In contrast to a lever body which is produced as a casting, which entails involved mechanical finish machining, this type has the advantage that it can be produced especially economically and, at the same time, accurately in mass production. A corresponding finger follower lever, which is provided at the valve-side end thereof with two guide checks for lateral guidance on the stem end of the lift valve, and a method for the production thereof are known, for example, from DE 100 30 341 C2.

In the production of the finger follower lever, the holes for accommodating the pin are preferably punched out of the side walls simultaneously and in opposite directions after the forming of the body of the finger follower lever. For this purpose, the lever body is placed in a punching tool, in which the insides of the two side walls rest against a punching tool die provided with an oversized hole and the holes are punched out simultaneously from the outside inward by two punching tool punches moved toward one another. During this process, the punched-out sheet-metal segments are pressed into the die so that the lever body can then be removed from the punching tool. This production method gives the best possible coaxial alignment between the two holes but cannot be employed without additional measures unless the inner spacing between the two side walls is greater than twice the wall thickness of the side walls.

While this condition is generally satisfied in the case of finger follower levers for simple valve trains, variable valve trains with sliding cam systems, like the known "Audi Valve Lift System (AVS)" and the known sliding cam system made by Schaeffler GmbH & Co. KG require relatively narrow finger follower levers where this condition cannot be satisfied because of restricted space conditions. In order to enable the holes nevertheless to be punched out simultaneously in opposite directions in this case, DE 10 2004 012 142 A1 proposes to provide a conical taper on the side walls in the region of the holes and, thus, to reduce the thickness of the sheet-metal segments punched out, However, since a defined chamfer to partially accommodate the pin material displaced radially during staking or caulking is required in any case when using pins with soft ends which are massively staked or caulked after insertion, the conical taper on the side walls must be centered accurately relative to the holes. During production of the conical taper on the side walls by stamping, raised portions are furthermore produced at the transition to the cylindrical holes, leading to increased pin contact pressure in the holes.

As described in DE 10 2009 032 143 A1, studies carried out by the applicant have now shown that uniformly through-hardened pins can also be used in such applications. Through-hardened pins can be produced more economically, do not require any chamfer on the outer edge of the respective hole and can be expanded radially by a sufficient amount for positive axial retention at the ends thereof by a single application of axial force using a staking or caulking bell with a concave shape in the area of contact.

SUMMARY OF THE INVENTION

It is therefore the underlying object of the invention to provide a finger follower lever of a valve train of the type stated at the outset, which has a lever body that is designed as a pressed and punched component made of sheet metal, in which the holes can be punched out simultaneously in opposite directions despite the narrow design and a uniformly through-hardened pin. The intention is furthermore to provide a method for producing a finger follower lever of this kind.

The invention is based on the insight that punching out the holes simultaneously in opposite directions can be accomplished even with a relatively narrow lever body where the inner spacing between the side walls is less than or equal to twice the wall thickness of the side walls, if the side walls are tapered in a suitable manner in the region of the holes (i.e., have a reduced wall thickness in a local area).

The substantive object of the invention is therefore achieved by virtue of the fact that at least one of the two side walls has, at least on the outside thereof, a flat recess in the region of the relevant hole.

Accordingly, the invention starts from a finger follower lever, known per se, of a valve train (e.g., that of a piston-type internal combustion engine). The lever body of the finger follower is a pressed and punched component made of sheet metal and has a U-shaped cross-section with two largely parallel side walls. Arranged between the side walls is a roller rotatably mounted on a pin. The pin is uniformly hardened through and inserted at each end into a hole punched out of the side wall and is staked or caulked at the ends.

By virtue of the fact that, according to the invention, at least one of the two side walls has, at least on the outside thereof, a flat recess in the region of the relevant hole. The local wall thickness of the side wall and hence also of the sheet-metal segment punched out to produce the hole is reduced, thus making it possible to punch out the two holes simultaneously in opposite directions even when the inner spacing between the two side walls is less than or equal to twice the wall thickness of the side walls outside the recess.

Each of the two side walls can be provided with at least one flat recess in a symmetrical arrangement since this doubles the effect of reducing the thickness of the punched out sheet-metal segments and it is possible to reduce the entry depth of the punch during the punching out of the holes in opposite directions.

Each of the flat recesses can also be arranged on the outside of the side walls since, in contrast to the case where they are arranged on the inside of the side walls, this allows the pin to be shortened and hence allows a reduction in the mass and the mass moment of inertia of the finger follower lever. However, there may also be special design or production reasons that require asymmetric arrangement of one or more flat recesses. Thus, for example, two flat recesses can be arranged on the inside and the outside, on one side wall only, or on the inside of one side wall and on the outside of the other side wall.

The at least one flat recess may be produced by stamping since this is the quickest and most economical production method in the case of a lever body which is in any case designed as a pressed and punched component made of sheet metal. During this process, the material is displaced into the edge zone of the recess and at the same time hardened by a stamping punch. In contrast, production of the at least one recess by removal of material, by planing, milling or grinding for example, which is likewise possible in principle, is not very advantageous, owing to the high production outlay, especially in mass production.

As regards the surface shape and arrangement of the flat recess, provision can be made for the flat recess to extend over a circular area aligned largely concentrically with the relevant hole, or for the flat recess to extend over a free area containing the relevant hole.

As regards the size of the flat recess, provision is made for the flat recess, when arranged on the outside of a side wall, to be of such a size and to be aligned in such a way relative to the associated hole that a staking or caulking bell used to expand the ends of the pin can enter axially therein since this enables problem-free staking or caulking of the ends of a correspondingly shortened pin.

The invention furthermore relates to a method for producing a finger follower lever for a valve train (e.g., that of a piston-type internal combustion engine), which has a lever body that is a pressed and punched component made of sheet metal and has a U-shaped cross-section with two largely parallel side walls. Between the side walls a roller is rotatably mounted on a pin. The pin is uniformly hardened through and inserted at each end into a hole punched out of the side wall and is staked or caulked at the ends, comprising the following working steps:

a) punching a blank out of a hot-rolled or cold-rolled steel strip;
b) forming the blank into a U-shaped lever body with two side walls, an end bearing contour for a supporting element and an end contact surface for the stern end of a lift valve;
c) simultaneous punching of the holes out of the side walls in opposite directions;
d) insertion of the roller between the side walls and of the pin into the holes;
e) radial expansion of the pin ends by the application of a respective axial force by means of a staking or caulking bell; and
f) stamping of at least one flat recess on the outside of a side wall in the region of the associated hole in an additional working step before or after working step b).

The at least one flat recess can be stamped into the underside of the blank, which subsequently forms the outside of the associated side wall, immediately after the punching out of the blank (i.e., between working steps a) and b)). For this purpose, it is possible, for example, to use a combined punching and stamping tool, which is also used for the preceding process of punching out the blank.

However, it is also possible for the at least one flat recess to be stamped into the outside of the associated side wall immediately before the holes are punched (i.e., between working steps b) and c)). This allows relatively accurate centering or alignment of the flat recess relative to the associated hole, which makes it possible to keep the area of the flat recess relatively small.

If respective flat recesses are stamped into the outsides of both side walls, there is also the possibility of stamping in the recesses simultaneously and in opposite directions using a suitable stamping tool (e.g., a combined stamping and punching tool), which is also used for the subsequent process of punching out the holes.

It is likewise also possible for the radial expansion of the pin ends to be accomplished with a suitable staking or caulking tool after the insertion of the roller and of the pin by the simultaneous application of an axial force in opposite directions by respective staking or caulking bells.

BRIEF DESCRIPTION OF THE DRAWINGS

The invention is further explained below in two embodiments with reference to the attached drawing, in which.

DETAILED DESCRIPTION OF THE INVENTION

Figure 1:
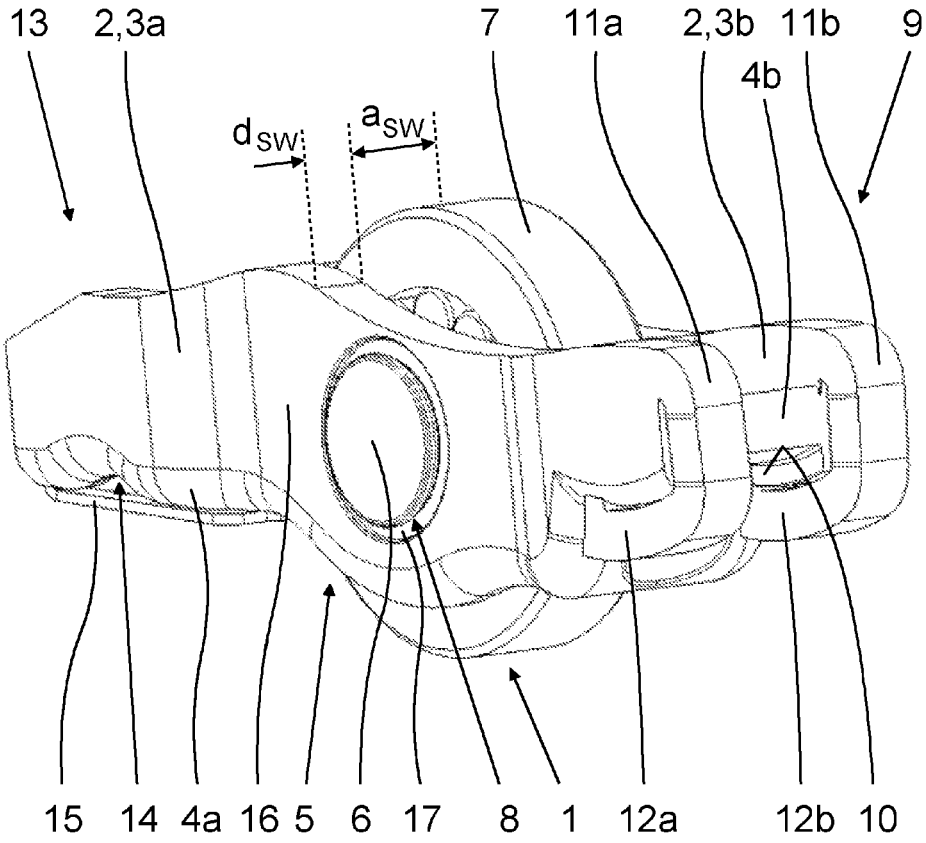
FIG. 1 shows a first embodiment of a finger follower lever according to the invention in a perspective view.
Figure 2:
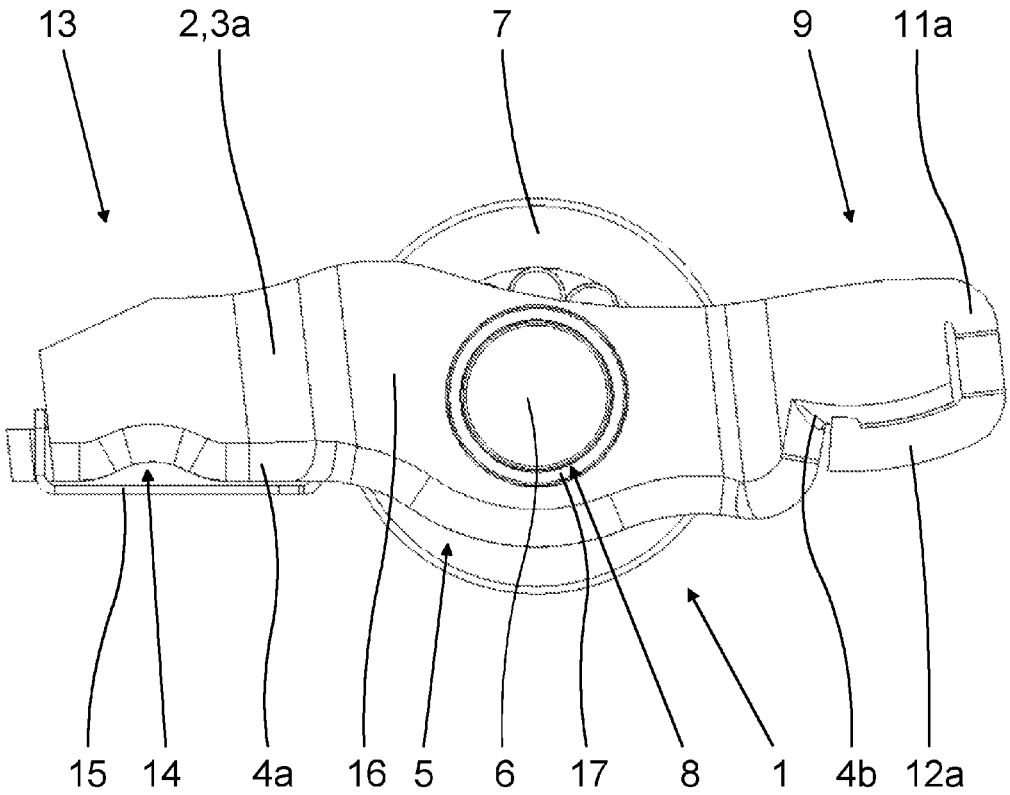
FIG. 2 shows the first embodiment of the finger follower lever according to the invention in accordance with FIG. 1 in a side view.

A first embodiment of a valve train finger follower lever 1 according to the invention, which is designed as a roller finger follower lever is illustrated in the perspective view of FIG. 1 and the side view of FIG. 2. The first embodiment includes essentially a lever body 2, which is a pressed and punched component made of sheet metal that has a U-shaped cross-section with two largely parallel side walls 3*a*, 3*b* and a base web 4*a*, 4*b*, which connects the side walls 3*a*, 3*b* and is interrupted by a roller pocket 5. Arranged between the side walls 3*a*, 3*b* is a roller 7, which is rotatably mounted on a pin 6 by rolling contact elements that protrudes through the roller pocket 5 and, when installed, is in contact with an associated cam of a camshaft (not shown).

The pin 6 is uniformly hardened through and inserted at each end into a hole 8 punched out of the side wall 3*a*, 3*b* and is staked or caulked at the ends. At the valve-side end 9 of the lever body 2, the web section 4*b* situated there has a convex contact surface 10 for sliding contact with the stem end of a lift valve (not shown). To provide lateral guidance for the lever body 2 on the stem end of the lift valve, webs 11*a*, 11*b* of the side walls 3*a*, 3*b*, which webs originally project in the longitudinal direction, are, in the present case and by way of example, formed to give guide webs 12*a*, 12*b*, which laterally delimit the contact surface 10 and are welded or staked/caulked to the web section 4*b* at the ends.

A bearing contour 14 is a spherical cup-shaped bearing socket for articulated support of the lever body 2 on a bearing journal that ends as a spherical cap. The journal, which belongs to a supporting element (not shown) on the housing side, is formed at the opposite, bearing-side end 13 of the lever body 2, in the web section 4*a* situated there. In order to fix the lever body 2 on the supporting element with limited capacity for movement, a retaining clip 15 is secured positively and/or nonpositively on the bearing-side web section 4*a*. The clip 15 engages laterally in an annular groove on the bearing journal of the supporting element in the installed state.

Since the lever body and the roller 7 are made relatively narrow, in order, for example, to enable them to be used in a variable valve train incorporating a sliding cam system and offering correspondingly restricted space conditions, it is difficult or impossible to punch the holes 8 out of the side walls 3*a*, 3*b* simultaneously in opposite directions. This applies especially when the inner spacing $a_{SW}$ between the side walls 3*a*, 3*b* is less than or equal to twice the wall thickness $d_{SW}$ of the side walls 3*a*, 3*b* ($a_{SW} \leq 2\ d_{SW}$).

To eliminate this disadvantage, the two side walls 3*a*, 3*b* have, on the outside 16 thereof, a flat recess 17 in a region of the relevant hole 8. During the production of the lever body 2, the flat recesses 17 are preferably produced by stamping and, in the embodiment of the finger follower lever 1 in accordance with FIG. 1 and FIG. 2, are designed as circular areas aligned largely concentrically with the relevant hole 8.

Figure 3:
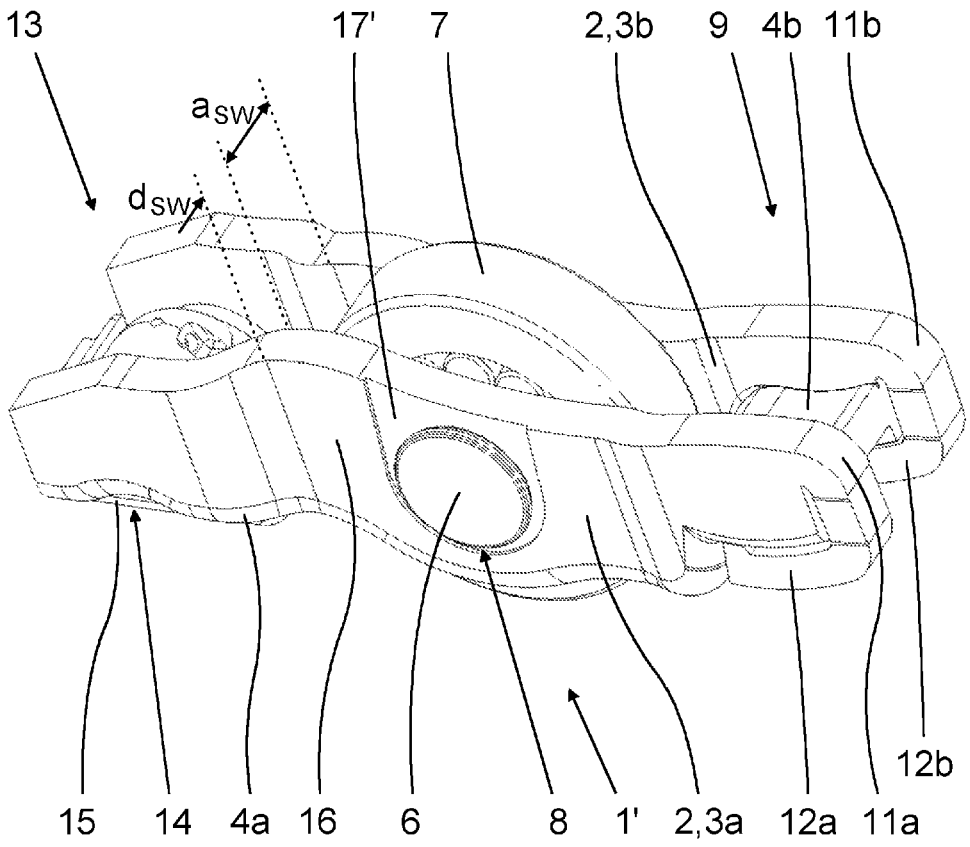
FIG. 3 shows a second embodiment of the finger follower lever according to the invention in a perspective view.

In a second embodiment of the invention, a valve train finger follower lever 1', which is designed as a roller finger follower lever, is illustrated in the perspective view of FIG. 3. Flat recesses 17' of the finger follower 1'0 are, in contrast to the first embodiment, designed as free areas which contain the relevant hole 8, surround the respective holes 8 in an arc and extend as far as the outer edge of the relevant side wall 3*a*, 3*b*.

The flat recesses 17, 17' reduce the wall thickness of the side walls 3*a*, 3*b* in the region of the holes 8, and the thickness of the sheet-metal segments punched out there is thus reduced to such an extent that they can be removed without problems during the simultaneous process of punching out in opposite directions (i.e., without jamming between the side walls 3*a*, 3*b*). It is advantageous if the flat recesses 17, 17' are also of such a size and aligned in such a way relative to the respectively associated hole 8 that a staking or caulking bell used to expand the ends of the pin 6 can enter axially therein. This makes it possible to shorten the pin 6, advantageously leading to the avoidance of a lateral overhang of the pin 6 and to a reduction in the mass and mass moment of inertia of the finger follower lever 1, 1'.

LIST OF REFERENCE SIGNS

1 Finger Follower Lever
1' Finger Follower Lever
2 Lever Body
3*a* Side Wall
3*b* Side Wall
4*a* Base Web, Bearing-Side Web Section
4*b* Base Web, Valve-Side Web Section
5 Roller Pocket
6 Pin
7 Roller
8 Hole
9 Valve-Side End of the Lever Body 2
10 Contact Surface
11*a* Web of the Side Wall 3*a*
11*b* Web of the Side Wall 3*b*
12*a* Guide Web
12*b* Guide Web
13 Bearing Side End of the Lever Body 2
14 Bearing Contour, Bearing Socket
15 Retaining Clip
16 Outside
17 Flat Recess
17' Flat Recess
$a_{SW}$ Inner Spacing between the Side Walls 3*a*, 3*b*
$d_{SW}$ Wail Thickness of the Side Walls 3*a*, 3*b*

What is claimed:

1. A finger follower lever of a valve train, comprising:

a lever body, which is a pressed and punched component made of sheet metal, having a U-shaped cross-section with two substantially parallel side walls, a hole punched out of each of the side walls and a flat recess formed at least on an outside of at least one of the side walls in a region of the hole, each flat recess being directly adjacent to and surrounding the respective hole, the lever body being thinner at the recesses than in areas directly adjacent to and surrounding the recesses;

a pin, which is uniformly hardened through and inserted at each end into the hole punched out of the side walls, and being staked or caulked at the ends; and a roller arranged in the lever body and rotatably mounted on the pin.

2. The finger follower lever according to claim 1, wherein the flat recess is stamped.

3. The finger follower lever according to claim 1, wherein the flat recess extends over a circular area of the side wall and is aligned substantially concentrically with the hole.

4. The finger follower lever according to claim 1, wherein the flat recess extends over a free area of the side wall containing the hole.

5. The finger follower lever according to claim 1, wherein the flat recess is of a size and is aligned relative to the hole so that a staking or a caulking bell can enter axially within the hole to expand the ends of the pin.

6. The finger follower lever according to claim 1, wherein ends of the pin extend radially along the respective recess.

7. A method for producing a finger follower lever for a valve train, the lever having a lever body, which is a pressed and a punched component made of sheet metal and has a U-shaped cross-section with two substantially parallel side walls with a roller rotatably mounted on a pin arranged between the side walls, the pin being uniformly hardened through and inserted at each end into a hole punched out of each of the side walls and is staked or caulked at each end, the method comprising the steps of:

a) punching a blank out of a hot-rolled or cold-rolled steel strip;

b) forming the blank into a U-shaped lever body with two side walls, an end bearing contour for a supporting element and an end contact surface for a stem end of a lift valve;

c) simultaneous punching the hole out of each of the side walls in opposite directions;

d) inserting the roller between the side walls and the pin into the hole formed in each of the side walls;

e) radially expanding each end of the pin by applying an axial force by a staking or a caulking bell; and f) stamping at least one flat recess on an outside of a side wall in a region of the hole before or after step b).

8. The method according to claim 7, wherein the stamping step includes stamping the at least one flat recess into an underside of the blank, which subsequently forms the outside of the at least one of the side walls, immediately after the punching of the blank.

9. The method according to claim 7, wherein the stamping step includes stamping the at least one flat recess into the outside of the at least one of the side walls immediately before punching the hole out of each of the side walls.

10. The method according to claim 9, wherein the stamping step includes stamping the at least one flat recess into the outside of both of the side walls in opposite directions.

11. The method according to claim 7, wherein the radially expanding step includes radially expanding the pin ends by a simultaneously applying an axial three in opposite directions by the staking or the caulking bell.

* * * * *